US011686565B2

(12) United States Patent
Kruger et al.

(10) Patent No.: US 11,686,565 B2
(45) Date of Patent: Jun. 27, 2023

(54) CONTROL CIRCUIT FOR A DETONATOR

(71) Applicant: DETNET SOUTH AFRICA (PTY) LTD, Johannesburg (ZA)

(72) Inventors: Michiel Jacobus Kruger, Johannesburg (ZA); Daniel Auguste Maurissens, Orbe (CH); Albertus Abraham Labuschagne, Brakpan (ZA); Andre Louis Koekemoer, Boksburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 171 days.

(21) Appl. No.: 17/422,228

(22) PCT Filed: Jan. 27, 2020

(86) PCT No.: PCT/ZA2020/050011
§ 371 (c)(1),
(2) Date: Jul. 12, 2021

(87) PCT Pub. No.: WO2020/160577
PCT Pub. Date: Aug. 6, 2020

(65) Prior Publication Data

US 2022/0082363 A1 Mar. 17, 2022

(30) Foreign Application Priority Data

Jan. 28, 2019 (ZA) ..... 2019/00559

(51) Int. Cl.
*F42C 19/12* (2006.01)
*F42D 1/04* (2006.01)

(52) U.S. Cl.
CPC ..... *F42C 19/12* (2013.01); *F42D 1/043* (2013.01)

(58) Field of Classification Search
CPC ..... F42C 15/36; F42C 15/40; F42C 19/12; F42D 1/043; F42D 1/045
See application file for complete search history.

(56) References Cited

U.S. PATENT DOCUMENTS

| | | | | |
|---|---|---|---|---|
| 11,506,465 | B1 * | 11/2022 | Foltz | F42D 1/043 |
| 2011/0155012 | A1 | 6/2011 | Perez Cordova et al. | |
| 2017/0322005 | A1 | 11/2017 | Labuschagne et al. | |
| 2020/0284570 | A1 * | 9/2020 | Brown | F42D 1/043 |
| 2022/0099422 | A1 * | 3/2022 | Kruger | F42D 1/045 |

FOREIGN PATENT DOCUMENTS

WO 2011044593 A1 4/2011

OTHER PUBLICATIONS

International Preliminary Report on Patentability for PCT/ZA2020/050011, international filing date of Jan. 27, 2020, date of completion Apr. 30, 2021, 13 pages.
International Search Report for PCT/ZA2020/050011, international filing date of Jan. 27, 2020, dated Jun. 4, 2020, 3 pages.
Written Opinion for PCT/ZA2020/050011, international filing date of Jan. 27, 2020, dated Jun. 4, 2020, 5 pages.

* cited by examiner

*Primary Examiner* — J. Woodrow Eldred
(74) *Attorney, Agent, or Firm* — Cantor Colburn LLP

(57) ABSTRACT

A control circuit for a detonator which includes a charger pump with an inductor which is connected to earth via a fusible link and wherein the charge pump is placed in an operative mode to produce a charging voltage for a firing capacitor if the link is fused in response to a shock tube event.

7 Claims, 2 Drawing Sheets

CONTROL CIRCUIT FOR A DETONATOR

CROSS-REFERENCE TO RELATED APPLICATIONS

This application is a U.S. national stage application of International Application No. PCT/ZA2020/050011 entitled "CONTROL CIRCUIT FOR A DETONATOR", which has an international filing date of 27 Jan. 2020, and which claims priority to South African Patent Application No. 2019/00559, filed 28 Jan. 2019.

WO 2011/044593 A1 discloses a detonator with a battery which is movable by a pressure wave from a shock tube to a position at which the battery is placed in electrical contact with a circuit which controls firing of an ignition element.

US 2011/155012 A1 discloses an electrical delay detonator for use in blasting initiation systems energized by a non-electric impulse signal transmitted through a shock tube with one end inserted inside a detonator housing having redundant sensors for detecting the presence of a non-electric impulse signal and a computerized control circuit for actuating the firing circuit. An elevated voltage is generated, stored in a capacitor assembly and discharged when fired to an electrically operable ignitor.

BACKGROUND OF THE INVENTION

This invention relates to a control circuit for a detonator which in use is initiated by detecting and validating a shock tube event.

SUMMARY OF THE INVENTION

The invention provides a control circuit for a detonator which is configured to be connected to an end of a shock tube which, upon ignition, generates a shock tube event at an end of the shock tube, wherein the control circuit includes a fusible link which is mounted to be responsive to a first characteristic of a shock tube event, a sensor which is mounted to be responsive to a second characteristic of a shock tube event, an energy source at a first voltage level, a charge pump which is configured, when operative, to produce an output voltage at a second voltage level which is higher than the first voltage level, the charge pump including an inductor which is connected to earth by the fusible link, the control circuit further including a capacitor which is connected to the charge pump, a switch, and a logic unit, and wherein the fusible link, upon detecting said first characteristic, is fused and the connection of the inductor to earth is then open-circuited, and the logic unit, upon detection by the sensor of said second characteristic, places the charge pump in an operative mode whereby said output voltage is applied to the capacitor and, upon operation of the switch, the capacitor is caused to discharge through an ignition element of the detonator and so fire the detonator.

The sensor may be a plasma detector, a light detector or may be responsive to pressure or temperature. The invention is not limited in this respect. The sensor may comprise a second fusible link.

The first and second characteristics may be the same or may differ.

The sensor and the fusible link may be mounted to be exposed to a shock tube wave front emitted from the end of a shock tube to which the detonator is connected.

BRIEF DESCRIPTION OF THE DRAWINGS

The invention is further described by way of example with reference to the accompanying drawings in which.

DESCRIPTION OF PREFERRED EMBODIMENT

Figure 1:
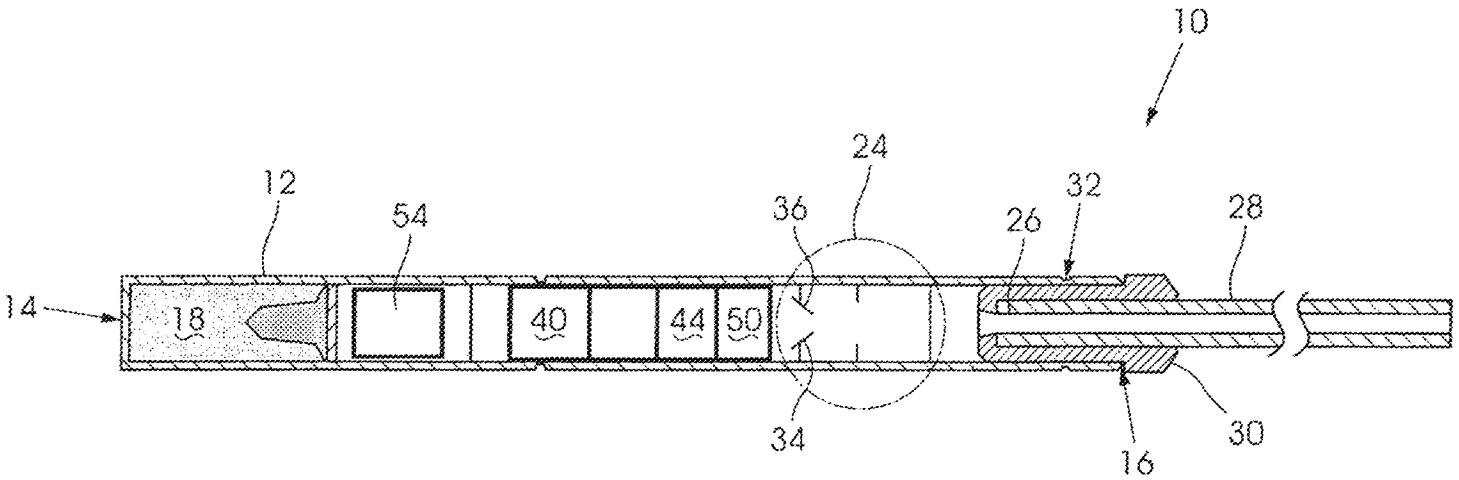
FIG. 1 illustrates components of a detonator with a control circuit according to the invention, and FIG. 2 schematically depicts aspects of the control circuit for the detonator shown in FIG. 1.

FIG. 1 of the accompanying drawings illustrates a detonator 10 which includes a tubular metallic housing 12 which is closed at one end 14 and which is open at an opposed end 16. A base charge 18 is positioned inside the housing 12 at the end 14. This is followed by an electronic module 22 and a sensing arrangement 24. An end 26 of a shock tube 28 is connected in use to the open end 16 of the tubular housing 12 by means of a plug 30 which is crimped (32) to the housing 12.

The sensing arrangement 24 includes a first fusible link 34 and a sensor 36. The sensor 36 may comprise a second fusible link or may consist of a plasma, temperature, or light sensor. These characteristics are exemplary only and are non-limiting. Preferably though the sensor 36 comprises a second fusible link.

Figure 2:
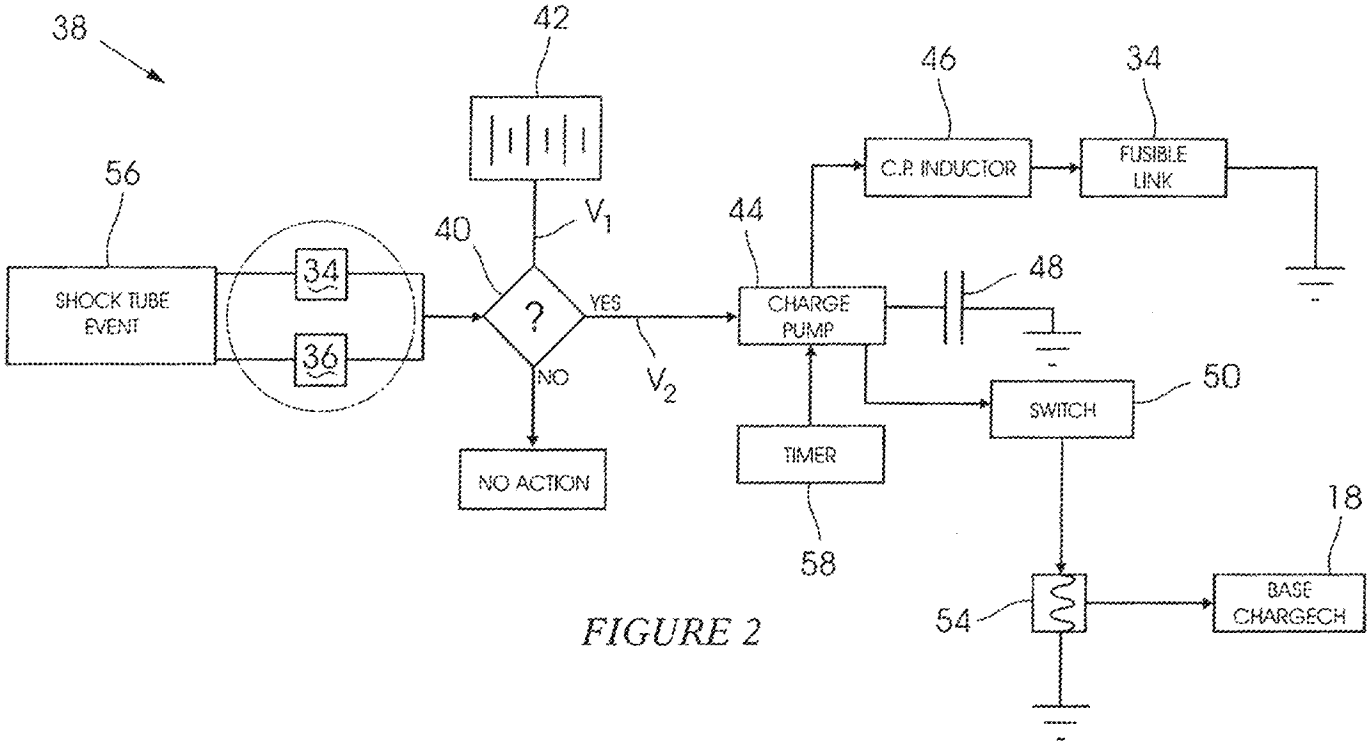

Referring additionally to FIG. 2, which depicts a control circuit 38 according to the invention, the module 22 includes a logic unit 40, a battery 42 which has an output at a voltage $V_1$, a charge pump or up-converter 44 which includes a charge pump inductor 46, a charge capacitor 48, a switch 50 which is operable to connect the capacitor 48, under controlled conditions, to an ignition element 54 of the detonator 10 which is exposed to the base charge 18, and a timer 58.

The sensing arrangement 24 is mounted to be responsive to a shock tube event 56 which is emitted from the end 26 of the shock tube 28 when the shock tube is ignited. The shock tube event has several characteristics such as pressure, temperature, light and plasma, and timing relationships between these characteristics, which are uniquely associated with the shock tube event. In the present situation the first fusible link 34 and the sensor 36 which, as noted, preferably comprises a second fusible link, are located so that they are directly exposed to a pressure wave produced by a genuine shock tube event 56 at the end 26 of the shock tube 28.

In the control circuit 38 shown in FIG. 2 the logic unit 40 ensures that the charge pump 44 is only enabled if the first fusible link 34 is in a fused state. Otherwise the charge pump 44 is inoperative for the inductor is earthed. The energy available from the battery 42 which is available at the voltage level $V_1$, is not applied to the charge pump 44. Also, even if energy were to be applied to the charge pump 44, the first fusible link 34, which connects the charge pump inductor 46 to earth, ensures that any energy which is applied to the inductor 46 is discharged to earth. Thus the control circuit 38 in FIG. 2 is held dormant. Additionally, while the charge pump 44 is inoperative, no energy is available from the charge pump to enable the switch 50 to be operated.

If a shock tube event 56 occurs this is detected by the sensing arrangement 24. If the nature of the shock tube event is such that the first fusible link 34 is fused then the connection established by the first fusible link 34 of the inductor 46 to earth is open-circuited. Moreover the charge pump 44 only becomes operative if energy is supplied by the battery 42 to the charge pump 44. The sensor 36, in this respect, functions as a logic indicator. If the first fusible link 34 is integral then it has a first logic state of say "0". If the first fusible link 34 is fused then its output changes its logic state which, in this example, is a change to a logic "1". When this occurs the charge pump 44 is enabled and as the inductor 46 is operative, the voltage $V_1$ from the battery 42, which is at a low level, is pumped to a higher level, $V_2$. The capacitor 48 is then charged with a specified amount of energy. Additionally, energy from the charge pump 44 is applied to the switch 50. At the conclusion of a timing interval determined by the timer 58, and subject to the satisfactory implementation of safety protocols executed to ensure reliable functioning of the detonator 10, the switch 50 is closed and the energy in the capacitor 48 is discharged through the ignition element 54 thereby to initiate the base charge 18.

The control circuit 38 is thus configured so that the charge pump or up-convertor 44 cannot generate any output voltage until the shock tube event 56 has caused the first fusible link 34 to be fused. Also, power to the charge pump 44 and to the switch 50 is only applied once a shock tube event 56 has been detected by the sensor 36 and has been validated by the logic unit 40. The voltage $V_1$ is too low to be used to charge the capacitor 48 to an operative state. The voltage in the charge capacitor 48 can thus only be increased once a valid shock tube event 56 has occurred and the first fusible link 34 and the second fusible link 36 have been fused. Fusing of the link 34 renders the inductor 46, and hence the charge pump, operative. The sensor 36 is used for validation purposes i.e. detection of two characteristics of a shock tube event, or detection of a characteristic by two discrete sensors, is required for validation purposes.

The invention claimed is:

1. A control circuit for a detonator which is configured to be connected to an end of a shock tube which, upon ignition, generates a shock tube event at an end of the shock tube, wherein the control circuit includes a fusible link which is mounted to be responsive to a first characteristic of a shock tube event, a sensor which is mounted to be responsive to a second characteristic of a shock tube event, an energy source at a first voltage level, a charge pump which is configured, when operative, to produce an output voltage at a second voltage level which is higher than the first voltage level, the charge pump including an inductor which is connected to earth by the fusible link, the control circuit further including a capacitor which is connected to the charge pump, a switch, and a logic unit, and wherein the fusible link, upon detecting said first characteristic, is fused and the connection of the inductor to earth is then open-circuited, and the logic unit, upon detection by the sensor of said second characteristic, places the charge pump in an operative mode whereby said output voltage is applied to the capacitor and, upon operation of the switch, the capacitor is caused to discharge through an ignition element of the detonator and so fire the detonator.

2. A control circuit for a detonator according to claim 1 wherein the sensor is a plasma detector, a light detector or is responsive to pressure or temperature.

3. A control circuit for a detonator according to claim 1 wherein the sensor comprises a second fusible link.

4. A control circuit for a detonator according to claim 1 wherein the first and second characteristics are the same.

5. A control circuit for a detonator according to claim 1 wherein the first and second characteristics differ.

6. A control circuit for a detonator according to claim 1 wherein the sensor and the fusible link are mounted to be exposed to a shock tube wave front emitted from the end of a shock tube to which the detonator is connected.

7. A control circuit for a detonator according to claim 1 wherein the charge pump is inoperative when the inductor is earthed by the fusible link.

* * * * *